US005439403A

United States Patent [19]

Rolla

[11] Patent Number: 5,439,403

[45] Date of Patent: Aug. 8, 1995

[54] MARINE TRACTOR SURFACE DRIVE SYSTEM

[76] Inventor: Philip M. Rolla, via Silva 5, 6828 Balerna, Switzerland

[21] Appl. No.: 203,990

[22] Filed: Feb. 28, 1994

[51] Int. Cl.[6] ..... B63H 25/42

[52] U.S. Cl. ..... 440/51; 440/75

[58] Field of Search ..... 440/75, 51, 79, 82, 440/83

[56] References Cited

U.S. PATENT DOCUMENTS

| | | | |
|---|---|---|---|
| 1,605,376 | 11/1926 | Schmitt | 440/82 |
| 1,682,815 | 9/1928 | Vincent | 440/82 |
| 1,770,744 | 7/1930 | Morgan | 464/158 |
| 1,932,523 | 10/1933 | Irgens | 440/75 |
| 1,990,387 | 2/1935 | Linthwaite | 440/75 X |
| 2,979,019 | 4/1961 | Leavitt et al. . | |
| 3,105,454 | 10/1963 | Baldwin | 440/82 |
| 3,105,455 | 10/1963 | Baldwin | 440/79 |
| 3,437,069 | 4/1969 | Bennett | 440/82 |
| 3,830,190 | 8/1974 | Mantle | 440/66 |
| 3,951,096 | 4/1976 | Dunlap | 440/66 X |
| 4,383,829 | 5/1983 | Allen, Jr. et al. | 440/66 |
| 4,443,202 | 4/1984 | Arena | 440/66 |
| 4,565,532 | 1/1986 | Connor | 440/75 X |
| 4,808,132 | 2/1989 | Douglas | 440/66 |

FOREIGN PATENT DOCUMENTS

| | | | |
|---|---|---|---|
| 0590141 | 6/1925 | France | 440/75 |

*Primary Examiner*—Sherman Basinger
*Attorney, Agent, or Firm*—Rogers, Howell & Haferkamp

[57] ABSTRACT

A marine tractor surface drive propulsion system is provided with a housing construction that can be retrofit to existing boat hulls and does not require a dedicated hull, with a parallel countershaft transmission that provides the efficiencies of a tractor surface drive and where a portion of the transmission housing extends over and protectively shields the,surface drive propeller of the drive system.

16 Claims, 2 Drawing Sheets

MARINE TRACTOR SURFACE DRIVE SYSTEM

BACKGROUND OF THE INVENTION

1. Field of the Invention

The present invention pertains to an improved marine propulsion system. In particular, the present invention pertains to improvements to a marine propulsion system of the type comprising a surface propeller, i.e., a propeller which is designed to be only partially submerged during operation so as to reduce the drag associated with the propeller. The propulsion system is a tractor-type system whereby the propeller is positioned ahead of the drive transmission housing so as to reduce the disturbances to the water upstream of the propeller, thereby improving the efficiency of the propeller. In addition, the present invention is designed with parallel drive and propeller shafts so that spur gears can be employed in the drive transmission, thereby eliminating unnecessary thrust bearings and improving the efficiency of the transmission gear train. As a further advantage of the present invention, the propulsion system is configured to enable easy retrofit of existing boat hulls and also the propeller is protected by the system.

2. Description of the Related Art

Tractor marine propulsion systems have long been known in the art. For instance, Schmitt U.S. Pat. No. 1,605,376 discloses a prior art tractor drive propulsion system. This system comprises an engine mounted substantially forward of the boat transom and a long drive shaft extending aft from the engine through the bottom of the hull to a gearbox mounted below the transom. A propeller shaft extends forward from the gearbox at an angle relative to the drive shaft and a propeller is attached to the propeller shaft so as to be totally submerged beneath the hull. The drive shaft in this system is angled relative to the propeller shaft, thus the gearbox includes bevel gears. Due to the conical shape of the bevel gears, axial forces are produced which must be compensated for by thrust bearings or excessive wear and gear train inefficiencies occur. In addition, much of the Schmitt propulsion system is beneath the water. Thus, the brackets, shafts and gearbox increase the drag on the boat moving through the water over that of the hull alone. In addition, the shafts are exposed along much of their length, thereby suscepting them to damage from debris.

Baldwin U.S. Pat. No. 3,105,455 also discloses a tractor drive propulsion system. The drive shaft and gearbox are mounted within the boat hull, thereby reducing drag and the potential for damage. In an alternate embodiment, Baldwin discloses a system having the motor substantially aft in the hull and the drive shaft extending forward to a universal Joint connected to the propeller shaft. The drive shaft and propeller shaft are angled relative to each other and the universal joint is needed to connect the two shafts. In both embodiments the propeller is completely submerged.

Leavitt et al. U.S. Pat. No. 2,979,019 eliminated the angle between the tractor system drive shaft and propeller shaft by incorporating a belt and pulley transmission. However, the size of the housing below the waterline is enlarged to accommodate the pulley mounted to the propeller shaft, and thus the frontal area of the underwater structure is increased. This increase in frontal area increases the drag associated with the system and therefore decreases the overall efficiency. In addition, belt drive transmissions inherently cannot transmit as much power as the gearbox transmissions without slipping.

All the aforementioned prior art propulsion systems have relatively large frontal and surface areas below the waterline. Thus, the drag is increased and the propulsion system efficiency decreased. Arena U.S. Pat. No. 4,443,202 substantially reduces drag by employing a surface propeller propulsion system. The Arena system is of the pusher-type, i.e., the propeller is mounted aft of its drive shaft. The surface drive propeller is more efficient because less of the propeller drive system housing is submerged and therefore the drag associated with the system is decreased. However, a pusher-type system is often less efficient than a tractor system because of the disturbances created in the flow over the propeller by the drive transmission housing positioned forward of the propeller. In addition, the Arena system requires a significant cowling to protect personnel from the prop when entering and exiting the boat over the transom, as well as to shield over the rooster tail spray inherent in surface drive systems.

SUMMARY OF THE INVENTION

The present invention overcomes disadvantages associated with prior art marine propulsion systems by providing an improved tractor drive propulsion system comprising parallel input and output shafts connected by a spur gear countershaft transmission. The transmission is contained in an inexpensive-to- manufacture, two-piece housing. A back section of the housing is easily removed for servicing and maintenance of the transmission. A tractor surface drive propeller is used. Thus, the advantages of the tractor-type transmission as well as the advantages of a surface-type propeller are combined to form a highly efficient marine drive system having minimal drag, minimal upstream disturbance ahead of the propeller, and an efficient gear train power transmission mechanism.

The unique configuration of the drive system properly positions the tractor surface drive propeller for use with a variety of different boat hull configurations. An upper portion of the system transmission housing extends horizontally aft from the transom some distance above the waterline. Extending downward from the aft end of the upper horizontal portion of the housing is a vertical portion of the housing. A lower fairing extends forward from the lower end of the vertical portion and mounted on the forward end of the lower fairing is a tractor surface drive propeller. An input drive shaft extends from the marine engine aft through the housing horizontal portion and is connected to a spur gear countershaft transmission which transmits power from the input shaft through the housing vertical portion to a propeller shaft extending forward through the lower fairing. Thus configured, the drive system housing covers over the surface propeller and avoids problems associated with rooster tail spray and reduces the risk of injury from inadvertent contact with the propeller.

By incorporating these several improved features recited above into one drive system, the tractor surface drive system of the present invention overcomes disadvantages commonly associated with the prior art marine drives.

BRIEF DESCRIPTION OF THE DRAWING FIGURES

Further objects and features of the present invention are revealed in the following Detailed Description of the Preferred Embodiment of the invention and in the drawing figures wherein.

DESCRIPTION OF THE PREFERRED EMBODIMENT

Figure 1:
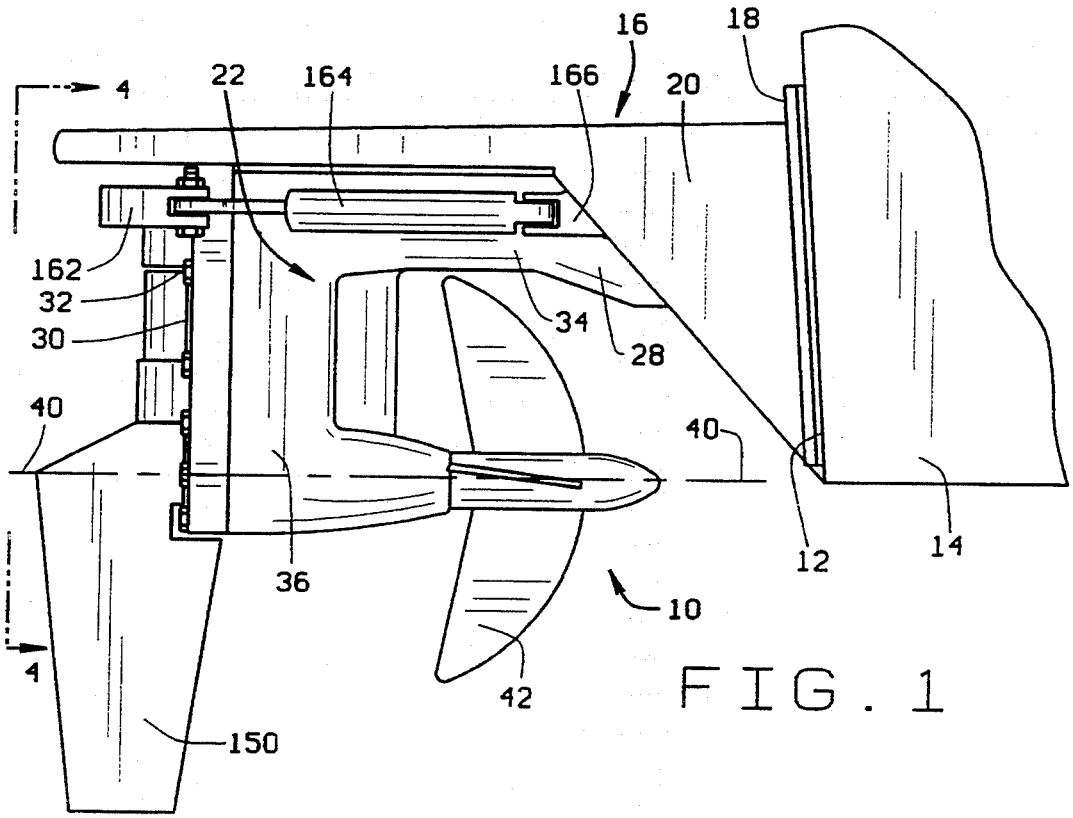
FIG. 1 is a side elevation view of the marine propulsion system of the present invention.
Figure 2:
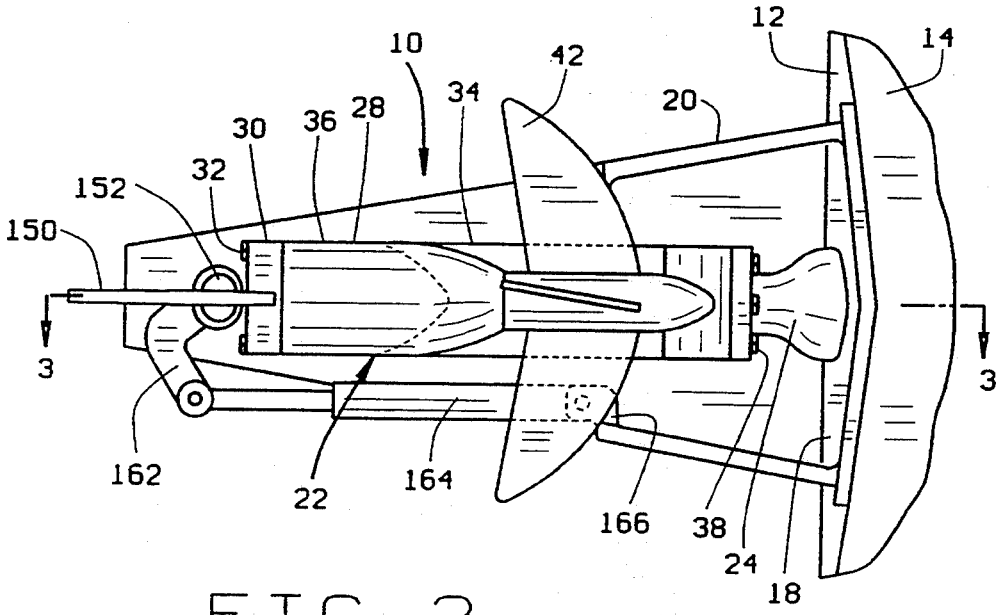
FIG. 2 is a bottom plan view of the marine propulsion system of the present invention.

The marine propulsion drive system 10 of the present invention is shown in FIG. 1 attached to a transom 12 at the rearward end of a boat hull 14. The transom 12 of the boat hull 14 shown in the drawing figures is only one example of a boat hull to which the drive system 10 of the present invention may be attached. The drive system of the invention is specifically designed to enable it to be retrofit to a variety of boat hull transoms having varying configurations. The boat hull shown in the drawing figures is equipped with a rearwardly projecting cowling 16 including an attachment plate 18 that is attached to the transom 12 of the boat by threaded fasteners or other equivalent means, and a shroud 20 that projects rearwardly from the attachment plate 18 over the drive system housing 22 of the invention. The cowling also includes a collar 24 that projects rearwardly from the attachment plate 18 and has a flange at its distal end for connection of the drive system housing 22 of the invention to the flange by threaded fasteners. The threaded fasteners connecting the drive system housing 22 to the collar 24 support the drive system 10 on the boat transom 12. The cowling 16 shown in the drawing figures makes up a part of the best mode of employing the drive system 10 of the invention but it should be understood that this is only one mode of employing the drive system. The drive system 10 of the invention is equally well suited for attachment directly to a boat transom without the use of the protective cowling 16 shown in the drawings. The drive system housing 22 may be bolted directly to the transom at the rear of a boat hull or alternatively, depending on the angle of the boat hull transom, an adaptor plate (not shown) may be positioned between the drive system housing 22 and the boat transom in order to mount the housing to the transom in the required orientation of the drive system yet to be explained.

The drive system housing 22 of the present invention is formed of only two parts, a forward section 28 and a rearward section 30 releasably attached to the forward section. The two section construction of the housing 22 enables the housing to be manufactured economically and also facilitates the servicing of the transmission component parts contained within the housing and yet to be described. As shown in the drawing figures, the housing forward and rearward sections 28, 30 come together in a single vertical plane with a gasket (not shown) positioned between the housing sections to provide a fluid tight seal. The forward and rearward sections of the housing are held together by a plurality of threaded fasteners or bolts 32 spatially arranged around the periphery of the rearward section 30 and screw threaded into the forward section 28 to releasably attach the two sections together. Removing the fasteners 32 enables separation of the rearward housing section 30 from the forward section 28 exposing the transmission component parts contained within the housing 22 for servicing.

With the forward and rearward housing sections assembled together by the plurality of bolts, the drive system housing 22 has a specialized configuration that includes a horizontally extending portion 34 and a vertically extending portion 36. The forward end of the housing horizontal portion 34 is attached to the cowling collar 24 by a plurality of threaded fasteners or bolts 38. However, as explained earlier, in variant embodiments of the drive system of the invention the forward end of the housing horizontal portion 34 may be attached directly to the boat transom. The housing horizontal portion 34 projects rearwardly from the transom to a rearward end of the horizontal portion where the configuration of the housing horizontal portion positions it above a waterline 40.

The term "waterline" as used herein is defined as a surface of a body of water directly behind the transom of a boat being propelled through the body of water by the drive system 10 of the invention. It should be appreciated that, depending on the configuration of the boat hull, the position of the waterline relative to the boat hull will vary. However, generally the waterline as defined above will be positioned at the bottom edge of the hull transom as is depicted in drawing FIG. 1. The waterline 40 is referred to herein to describe the relative positions of component parts of the drive system 10 of the invention and regardless of the configuration of the boat hull with which the drive system is employed, the relative positions of the component parts of the drive system 10 to the waterline 40 as described herein are to remain the same for the best mode of operation of the drive system.

The housing vertical portion 36 extends from a top end of the vertical portion that merges into the rearward end of the housing horizontal portion downwardly to a bottom end of the vertical portion that is positioned just below the waterline 40. The configuration of the housing vertical portion 36 positions a surface propeller 42 driven by the transmission of the drive system yet to be described directly beneath the housing horizontal portion 34 and forward of the vertical portion 36 to provide a surface tractor drive where only a portion of the propeller 42 is below the waterline 40 in operation of the drive system 10.

Figure 3:
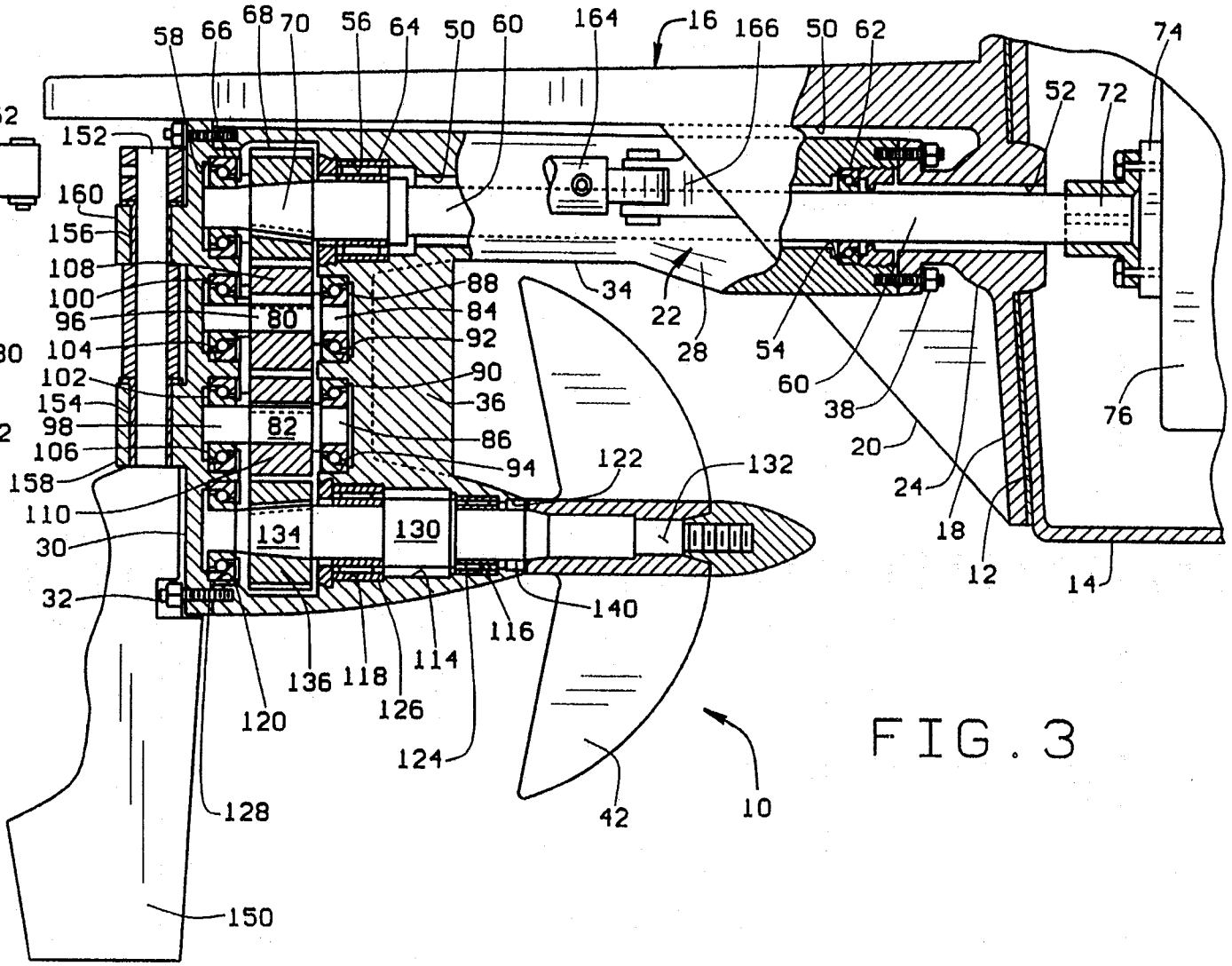
FIG. 3 is a side elevation view, partially in section, of the marine propulsion system taken in the plane of line 3—3 of FIG. 2.
Figure 4:
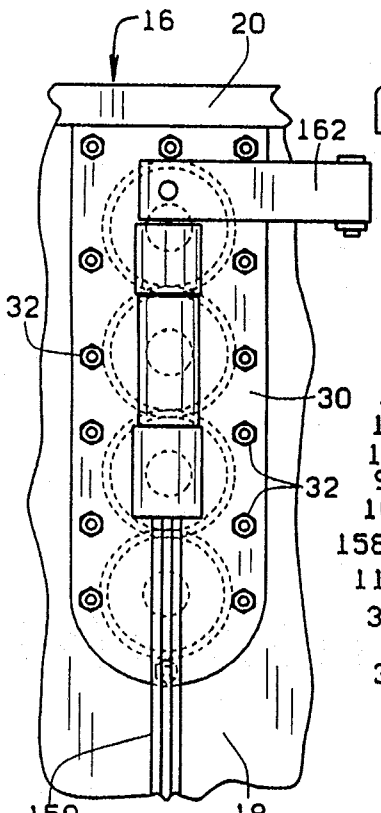
FIG. 4 is a partial rear view of the marine propulsion system in the direction of line 4—4 of FIG. 3.

Referring to the interior of the drive system housing 22 shown in FIG. 3, the housing horizontal portion 34 has an input shaft bore 50 extending horizontally substantially completely through the horizontal portion. The input shaft bore 50 aligns with a center bore 52 of the cowling collar 24. Three annular bearing seats 54, 56, 58 are formed in the housing horizontal portion along the input shaft bore 50. As seen in FIG. 3, the third bearing seat 56 is formed in the rearward section 30 of the housing. The input shaft 60 of the drive system transmission extends through the input shaft bore 50 and is mounted for rotation by three conventional bearing assemblies 62, 64, 66 mounted in the three bearing seats 54, 56, 58, respectively. The bearing assemblies are secured in their respective seats in any conventional manner. It is pointed out that the bearing assembly 62 at the forward end of the housing horizontal portion 34 is accessible by removing the housing from the cowling collar 24 and the bearing assembly 64 at the rearward end of the housing horizontal portion, together with the bearing assembly 66, is accessible by removing the rearward section 30 of the housing and removing the input drive shaft from the housing. A drive gear 68 is mounted on the input shaft rearward end 70 between the two bearing assemblies 64, 66. The drive gear is preferably a spur gear to avoid the creation of any axial forces in the drive shaft 60 during operation of the transmission and to eliminate the need for thrust bearings in mounting the drive shaft and the remaining component parts of the transmission yet to be described. The input shaft forward end 72 is shown connected to the output shaft 74 of a motor 76 of the boat to which the drive system 10 of the invention is attached. The input shaft forward end 72 is adapted to enable connection of the input shaft to a variety of different motor drive shafts thereby enabling the drive system 10 of the invention to be employed with boats having a variety of different motive sources.

The drive transmission of the present invention also includes a pair of countershafts 80, 82 mounted in the vertical portion 36 of the system housing. As seen in FIG. 3, both countershafts 80, 82 have forward ends 84, 86 mounted for rotation in bearing assemblies 88, 90 that in turn are mounted in annular bearing seats 92, 94 formed in the forward section 28 of the housing, and both have rearward ends 96, 98 mounted for rotation in bearing assemblies 100, 102 that are secured in annular bearing seats 104, 106 formed in the rearward section 30 of the housing. The two countershafts 80, 82 have spur idler gears 108, 110 secured thereto with the first idler gear 108 in mesh with the drive spur gear 68 of the input shaft and also in mesh with the second idler gear 110. Again, the use of spur gears as the idler gears 108, 110 is preferable to prevent the creation of any axially directed forces in the Countershafts 80, 82 of the transmission. As is apparent from FIG. 3, the countershafts 80, 82 and their associated bearings and idler gears are accessible for servicing by removing the rearward section 30 of the drive system housing 22.

The bottom end of the housing vertical portion 36 is provided with an output shaft bore 114 that extends therethrough. The output shaft bore 114 has a center axis that is parallel to and lies in the same vertical plane as a center axis of the input shaft bore 50. Like the input shaft bore, the output shaft bore 114 is provided with three annular bearing seats 116, 118, 120 spatially arranged along its axial length beginning at an opening 122 to the output shaft bore 114 through the front of the housing vertical portion 36. Three bearing assemblies 124, 126, 128 are mounted in the respective annular bearing seats 116, 118, 120 formed along the output shaft bore 114, with the third bearing assembly 128 being mounted in its bearing seat 120 in the rearward section 30 of the drive system housing. The three bearing assemblies mount a transmission output shaft 130 for rotation in the housing vertical portion 36 with a forward end 132 of the output shaft projecting forwardly through the bore opening 122 of the housing vertical portion. The output shaft rearward end 134 is mounted for rotation in the third bearing assembly 128 mounted in the housing rearward section 30. Mounted on the output shaft rearward end 134 between the second and third bearing assemblies 126, 128 is a driven spur Gear 136 that meshes with the second idler Gear 110 mounted on the second countershaft 82. The forward end 132 of the output shaft projects through an annular seal 140 mounted in the output shaft bore opening 122. The seal prevents water from entering into the interior of the drive system housing 22 and prevents transmission gear lube contained in the housing interior from leaking. A conventional surface drive propeller 42 is mounted on the output shaft forward end 132 in a conventional manner. As with the input shaft and the countershafts, the bearing assemblies and driven spur gear of the output shaft 130 may be easily serviced by removing the housing rearward section 30 from the forward section 28.

From the description of the transmission of the drive system 10 provided above, it should be apparent that by controlled rotation of the transmission input shaft 30 from the motor of the boat to which the drive system is attached, the transmission output shaft 130 and the surface drive propeller 32 secured thereto may be driven at varying speeds and in opposite directions to propel the boat to which the drive system is attached in forward and reverse at different speeds.

To control direction changes in the travel of the boat to which the drive system 10 is attached, a rudder 150 is attached to the rearward section 30 of the housing on an opposite side of the housing vertical portion 36 from the surface drive propeller 42. The rudder 150 has a control shaft 152 that projects upwardly from the rudder through a pair of bushing sleeves 154, 156 that in turn are mounted in a pair of collars 158, 160, respectively, that project rearwardly from the housing rearward section 30. The collars and their associated bushing sleeves mount the control shaft 152 and the rudder 50 for pivoting movement about a vertical axis (not shown) extending through the center of the control shaft. A crank arm 162 is secured to the top end of the control shaft 152 and projects out to a side of the drive system housing 22 where it is connected to a piston rod of a conventional piston/cylinder actuator 164. The piston/cylinder actuator 164 is mounted to a bracket 166 secured to the cowling 16. The actuator 164 is selectively controlled to extend and retract the piston rod from the actuator in response to supply of hydraulic fluid (not shown) to the actuator in a conventional manner to rotate the rudder 115 about the center axis of the control shaft 152 and thereby steer the direction in which the boat is propelled by the drive system 10. Although a hydraulic actuator 164 is shown, steering of the rudder 150 can be controlled in any conventional manner including a conventional steering cable mechanism.

The marine propulsion drive system 10 described above provides a unique drive system that is easily retrofit to existing boat hulls and does not require a dedicated hull for use of the system. The transmission housed in the drive system provides a zero degree shaft angle between the input shaft 60 and output shaft 130 of the transmission, and the configuration of the system provides the efficient benefits of a tractor surface drive propulsion system. The drive system housing configuration also extends over and protects the surface drive propeller. The transmission itself employs a plurality of spur gears and eliminates axially directed forces through the transmission input shaft, countershafts, and output shaft that would be present with the use of bevel gears in the transmission, as is done in the prior art. The two piece housing of the drive system is inexpensively manufactured and provides a simple mechanical construction that is easily repaired in the field.

While the present invention has been described by reference to a specific embodiment, it should be understood that modifications and variations of the invention may be constructed without departing from the scope of the invention defined in the following claims.

What is claimed is:

1. A drive system for a boat having a hull with a transom at a rearward end of the hull and having a motor mounted in the boat within the hull, the hull having a configuration that will float the boat on a body of water with a surface of the body of water delineating a waterline around the boat hull as the hull is propelled through the body of water by the drive system, the drive system comprising:

a housing having a horizontal portion and a vertical portion, the horizontal portion having a forward end and a rearward end with the forward end having means for attaching the housing to a transom of a boat in a position relative to the transom where the housing horizontal portion extends rearwardly from the transom above the waterline of the boat, the vertical portion having a top end and a bottom end with the top end connected to the rearward end of the housing horizontal portion, and the vertical portion extending downwardly from the horizontal portion to the bottom end of the vertical portion where the vertical portion has a configuration to position the bottom end below the waterline of the boat to which the housing is attached;

a propeller mounted on the housing vertical portion for rotation of the propeller relative to the housing and at a position on the vertical portion where the propeller is forward of the vertical portion and only a portion of the propeller is positioned below the waterline of the boat to which the housing is attached;

a transmission contained inside the housing and connected to the propeller for driving the propeller in rotation, the transmission including means for connecting the transmission to a motor of the boat to which the housing is attached to drive rotation of the propeller from the motor, and;

the horizontal portion of the housing has a configuration that extends the horizontal portion rearwardly from its forward end to its rearward end directly over the propeller.

2. The drive system of claim 1, wherein:

the transmission includes an input shaft mounted for rotation in the horizontal portion of the housing and adapted to be connected to a motor of a boat to which the housing is attached, an output shaft mounted for rotation in the vertical portion of the housing, the output shaft being parallel to the input shaft and having a forward end projecting forwardly out of the housing vertical portion with the propeller mounted on the forward end of the output shaft, and a gear train providing a driving connection through the housing vertical portion between the input shaft and the output shaft.

3. The drive system of claim 2, wherein: the gear train is a spur gear train.

4. The drive system of claim 2, wherein:

the transmission is a countershaft transmission with at least one countershaft mounted for rotation in the housing vertical portion, the countershaft being parallel to the input shaft and the output shaft.

5. The drive system of claim 4, wherein:

the input shaft, the countershaft and the output shaft all have center axes that lie in one vertical plane.

6. The drive system of claim 4, wherein:

the housing has a forward section and a rearward section that are releasably connected to each other, and the input shaft, the countershaft, and the output shaft all have opposite forward and rearward ends, the forward ends of the input shaft, countershaft and output shaft are mounted for rotation in the forward section of the housing and the rearward ends of the input shaft, countershaft and output shaft are mounted for rotation in the rearward section of the housing.

7. The drive system of claim 2, wherein:

the housing has a forward section and a rearward section that are releasably connected to each other, and the input and output shafts have opposite forward and rearward ends, the forward ends of the input and output shafts are mounted for rotation in the forward section of the housing and the rearward ends of the input and output shafts are mounted for rotation in the rearward section of the housing.

8. The drive system of claim 1, wherein:

a rudder is mounted on the housing for pivoting movement of the rudder about a vertical axis relative to the housing, the rudder is positioned on the housing rearwardly of the housing vertical portion.

9. A drive system for a boat having a hull with a transom at a rearward end of the hull and having a motor mounted in the boat within the hull, the hull having a configuration that will float the boat on a body of water with a surface of the body of water delineating a waterline around the boat hull as the boat is propelled through the body of water by the drive system, the drive system comprising:

a housing having a horizontal portion and a vertical portion, the horizontal portion having a forward end and a rearward end with the forward end having means for attaching the housing to a transom of a boat in a position relative to the transom where the housing horizontal portion extends rearwardly from the transom above the waterline of the boat, the vertical portion having a top end and a bottom end with the top end connected to the rearward end of the housing horizontal portion, and the vertical portion extending downwardly from the horizontal portion to the bottom end of the vertical portion where the vertical portion has a configuration to position the bottom end below the waterline of the boat to which the housing is attached;

a propeller mounted to the housing vertical portion at a position forward of the vertical portion and directly beneath the horizontal portion for rotation of the propeller relative to the housing; and, a transmission contained inside the housing, the transmission including an input shaft mounted for rotation in the housing horizontal portion and adapted to be connected to a motor of the boat to which the housing is attached, and an output shaft mounted for rotation in the housing vertical portion, the output shaft being parallel to the input shaft and having a forward end projecting forwardly out from the housing vertical portion with the propeller mounted on the forward end of the output shaft at least one countershaft mounted for rotation in the housing vertical portion, the countershaft being parallel to the input shaft and output shaft, and a gear train comprised of a plurality of gears mounted on the input shaft, countershaft and output shaft providing a driving connection through the housing vertical portion between the input shaft and the output shaft.

10. The drive system of claim 9, wherein:

the plurality of gears of the drive train are all spur gears.

11. The drive system of claim 9, wherein:

the input shaft, the countershaft and the output shaft all have center axes aligned in a single vertical plane.

12. The drive system of claim 9, wherein:

the transmission includes a second countershaft mounted for rotation in the housing vertical portion, the second countershaft is parallel to the input shaft, countershaft and the output shaft, and the gear train is comprised of a first spur gear mounted on the input shaft, a second spur gear mounted on the countershaft and in mesh with the first spur gear, a third spur gear mounted on the second countershaft and in mesh with the second spur gear, and a fourth spur gear mounted on the output shaft and in mesh with the third spur gear.

13. The drive system of claim 9, wherein:

the propeller is a water surface propeller and the housing vertical portion has a configuration to position the propeller at the waterline of the boat to which the housing is attached with a portion of the propeller below the waterline and a portion of the propeller above the waterline.

14. The drive system of claim 9, wherein:

the housing is comprised of a forward section and a rearward section that are releasably connected to each other, and the input shaft, the countershaft and the output shaft all have opposite forward and rearward ends, the forward ends of the input shaft, countershaft and output shaft are all mounted for rotation in the forward section of the housing and the rearward ends of the input shaft, countershaft and output shaft are all mounted for rotation in the rearward section of the housing.

15. The drive system of claim 14, wherein:

a rudder is mounted on the housing rearward section for pivoting movement of the rudder about a vertical axis relative to the housing.

16. The drive system of claim 9, wherein:

a rudder is mounted on the housing for pivoting movement of the rudder about a vertical axis relative to the housing, the rudder is positioned on the housing rearwardly of the housing vertical portion.

* * * * *